United States Patent [19]

Forte, Sr.

[11] 4,043,368

[45] Aug. 23, 1977

[54] ADJUSTABLE GARBAGE CAN COVER

[76] Inventor: John M. Forte, Sr., 13 Colfax Drive, Pequannock, N.J. 07440

[21] Appl. No.: 685,618

[22] Filed: May 12, 1976

[51] Int. Cl.[2] ..... B65D 55/16

[52] U.S. Cl. ..... 150/52 R; 220/1 T; 220/375

[58] Field of Search ..... 220/1 T, 200, 315, 375; 150/52 R, 52 G

[56] References Cited

U.S. PATENT DOCUMENTS

| | | | |
|---|---|---|---|
| 207,131 | 8/1878 | Parks | 220/375 X |
| 638,334 | 12/1899 | Hobert | 220/375 |
| 1,130,086 | 3/1915 | Hobbs | 220/1 T |
| 1,183,490 | 5/1916 | Pollgreen | 220/375 X |
| 2,307,569 | 1/1943 | Conners | 150/52 R UX |
| 2,432,662 | 12/1947 | Gardner | 150/52 R |
| 2,437,372 | 3/1948 | Ballard | 150/52 R X |
| 2,446,155 | 7/1948 | Karle | 220/375 X |
| 2,731,055 | 1/1956 | Smith | 150/52 R X |
| 2,821,230 | 1/1958 | May | 150/52 R |
| 2,923,305 | 2/1960 | Cline | 150/52 R |

*Primary Examiner*—Donald F. Norton

[57] ABSTRACT

A cover for use with a garbage can that has elastic coupling means for enclosing the open end of the can with flexible hood means connected to the coupling means to form a dome with gripping means connected to the upper end of the dome. Connecting means is provided between the dome and the handle on the can so that the cover may hang from the can when not in use.

3 Claims, 3 Drawing Figures

ADJUSTABLE GARBAGE CAN COVER

BACKGROUND OF THE INVENTION

This invention relates generally to new and useful improvements in covered receptacles, particularly but not necessarily garbage and trash cans, and has for its primary object to provide novel covers for such receptacles in position thereon in a manner to positively prevent unauthorized or accidental removal as by wind, animals, etc.

It is generally well known to most homeowners that garbage cans containing refuse and garbage are subject to having stray animals lift the garbage can lid off therefrom so to gain access to the garbage, the animals often turning the can over and thus scattering the same about the premises.

In urban areas, such stray animals may comprise dogs and cats who are capable of lifting off the lid. In rural areas, such stray animals may comprise racoons as well as other animals who in their search for food, make their nocturnal round of raiding garbage cans. This situation is, of course, objectionable in view that it promotes an increased infestation of rats or mice who live upon the strewn garbage.

This situation is further objectionable in view that it requires labor to clean up the mess and increases the danger to good health by access of flies to the garbage. This situation is accordingly in want of improvement.

OBJECTS OF THE INVENTION

An object of the present invention is to provide a cover of the aforementioned character which, without the use of special tools or equipment, may be readily installed for use on existing cans and, if desired, removed therefrom and transferred to cover other cans.

A further object of the invention is to provide a cover of the character described which may be readily released and removed.

A further object is to provide a cover of the character set forth which is readily adjustable to meet various conditions.

Other objects are to provide a receptacle cover of comparatively simple construction, which is strong, durable, and which may be manufactured at low cost.

Accordingly, another object of the present invention is to provide a cover assembly for the purpose of enclosing the garbage can.

Another object of the present invention is to provide a cover assembly which comprises a unit having tensile elasticity so that the same may be fitted across the top of a garbage can the opposite end of the cover being removably secured to a handle of the can.

Other objects of the present invention are to provide a cord assembly which is simple in design, inexpensive to manufacture, rugged in construction, easy to use and efficient in operation.

These and other objects of the present invention will become evident upon a study of the following specification and the accompanying drawing hereinafter discussed.

SUMMARY OF THE INVENTION

The improved cover is adapted to fit all sizes of garbage cans and other containers and slips easily on and off thereof. Since the cover is made of a plastic or rubber material, there is no associated noise, or banging when it is put on and removed from the can.

Since it is of a plastic or other material, it can easily be made for indoor and outdoor use in a variety of colors. The cover is ideal for areas that are closely monitored by health department agencies and in hospitals, schools, restaurants, etc.

To provide the flexibility in a cover not previously available, the inventor makes use of elastic coupling means that includes an elastic band that peripherally engages the rim of the can in snug fashion and can be collapsed when the cover is removed and stored. A flexible hood is secured to the elastic means and forms a dome that covers the open end of the garbage can. This is ideal since the user can have the garbage extend above the open end of the can and still have the cover in place. Gripping means is connected to the upper end of the hood means to assist the user in removing the cover. In addition connecting means is provided that is connected at one end to the gripping means and the other end secured to the garbage can handle.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DESCRIPTION OF PREFERRED EMBODIMENTS

Figure 1:
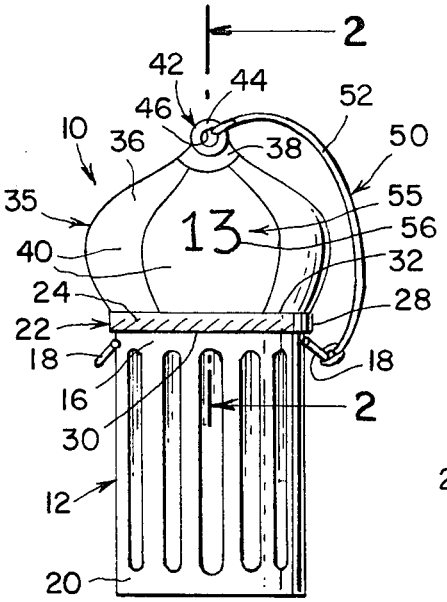
FIG. 1 is a side elevational view of a garbage or trash can provided with the cover in accordance with the present invention.
Figure 2:
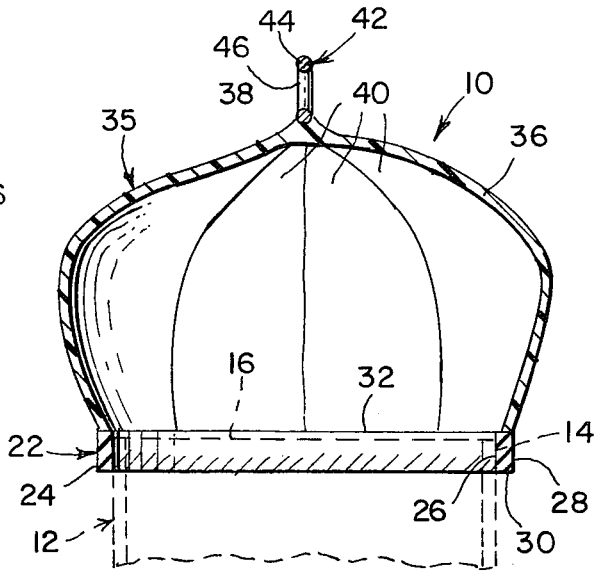
FIG. 2 is a view in vertical section through the cover.
Figure 3:
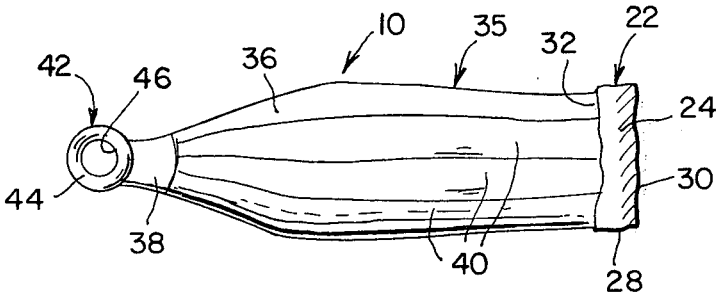
FIG. 3 is a view of the cover in its folded position.

Referring now to the drawing in detail, it will be seen that reference numeral 10 in FIGS. 1-3 designates the cover means in accordance with the invention used in conjunction with a garbage or trash can 12 of suitable dimensions. The can 12 may also be of suitable metal or other material. The top portion of the can 12 is rolled as usual to provide an outwardly turned edge 14 defining an open end 16 with a pair of handles 18 connected to the side wall 20 of the can adjacent the open end portion 16. In view of the flexible nature of the cover 10 its use is not limited to circular cans 12 but rectangular ones as well.

The cover 10 includes elastic coupling means 22 having an elastic band 24 with an inner wall 26 and spaced apart outer wall 28. In addition a lower wall 30 forms the bottom of the cover with a spaced apart upper wall 32. The inner wall 26 is adapted to be stretched into surrounding circumferential relation with the edge 14 defining the open end of the garbage can 12. Due to the fact that the elastic band 24 is stretchable, it can conform to the shape and size of a variety of cans 12. This is an added advantage since the cover 10 is to be used as an accessory with existing cans that are presently being manufactured.

Flexible hood means 35 extends from the coupling means 22 such as from the upper wall 32 and maybe integrally moulded therewith so that a seal therebetween is obtained. In this manner, the open end 16 of the can 12 is covered by the hood means 35 to prevent entrance to the can 12 as well as keeping the garbage contained therein.

The hood means 35 is comprised of an expandable body 36 that extends from the wall 32 and terminates at the top 38 of the hood means 35. The expandable body 36 includes circumferentially a plurality of elongate arcuate interconnected panels 40 that extend first generally axially from the wall 32 and then mutually inwardly and joined at the upper edge or top 38 of the hood means 35. The panels 40 are of sheet material adapted to be collapsed into a folded closed position when the cover 10 is stored as seen in FIG. 3. In addition in the open position of the cover 10 the panels form a dome which permits the garbage to extend above the edge 14 of the can 12.

To facilitate removal of the cover 10 from the can 12 gripping means 42 is provided that may be firmly secured to the top 38 of the hood means 35. The gripping means 42 may include a ring 44 having an opening 46 adapted to receive a finger of the user so that it may be gripped in removing the cover from the can.

If desired when the cover 10 is removed from operative relation with the can 12, connecting means 50 is provided which may be in the form of a flexible member 52 that is firmly secured at one end to the ring 44 and at its opposite end to the handle 18 of the can 12.

To avoid confusion as to which cover 10 belongs to which home or user, indicia means 55 may be employed on the body 36 of the hood means 35 and the indicia means 55 is of a size to be visible from afar and may be in the form of a numeral 56 indicating the house number of the owner of the can.

There has been provided a garbage can cover which is easily secured to and removed from the can and will promote cleanliness on a premises by preventing garbage being strewn about by wild animals, and which accordingly will promote a flight against rats, mice and flies.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A cover for use with a garbage can having a handle and an open upper end comprising:

A. elastic coupling means including an elastic band that is adapted to be stretched into surrounding circumferential relation with the open upper end of the garbage can and collapsed when the cover is removed and stored, B. flexible hood means having a top end and a bottom end, said bottom end peripherally secured to said elastic means at one end thereof so that the open end of the garbage can is covered by said hood means, C. said hood portion comprising an expandable body including circumferentially a plurality of elongate arcuate elastic interconnected panels that extend first generally axially and then mutually inwardly and joined at the upper edge to said top end, said hood adapted to be collapsed into a folded elongated position when the cover is removed from the can and into a dome in the open position extending above said elastic band, D. gripping means connected to the upper end of said flexible hood means at said upper edge of said panels, E. said gripping means including a ring adapted to be gripped in removing the cover from the can, F. connecting means coupled to said gripping means at one end thereof and adapted to be secured to the handle of the can, and G. said connecting means being in the form of an elongated flexible member extending from said ring of said gripping means and of a length for securement to the handle of the can.

2. A cover as defined in claim 1, and further including indicia means contained on said hood means and visible from afar.

3. A cover as defined in claim 2, wherein said indicia means is in the form of a numeral indicating the house number of the owner of the can.

* * * * *